United States Patent [19]

Ryan et al.

[11] Patent Number: 4,608,808

[45] Date of Patent: Sep. 2, 1986

[54] APPARATUS AND METHOD FOR CASE PACKING FLEXIBLE BAGS

[75] Inventors: Philip J. Ryan; Harris B. McKee, both of Dallas, Tex.

[73] Assignee: Frito-Lay, Inc., Dallas, Tex.

[21] Appl. No.: 623,406

[22] Filed: Jun. 22, 1984

[51] Int. Cl.[4] ..... B65B 1/24

[52] U.S. Cl. ..... 53/436; 53/245; 53/248; 53/260; 53/527; 53/535; 414/83

[58] Field of Search ..... 53/244, 245, 248, 251, 53/273, 436, 438, 447, 475, 527, 534, 535, 541, 148, 255, 258, 260, 261, 540; 414/70, 76, 77, 86, 87, 907, 82, 83; 100/226, 229 R

[56] References Cited

U.S. PATENT DOCUMENTS

| | | | |
|---|---|---|---|
| 1,090,855 | 3/1914 | Jagenberg | 53/534 |
| 3,024,585 | 3/1962 | Schubert et al. | 53/148 X |
| 3,370,395 | 2/1968 | Siegenthaler | 53/148 X |
| 3,425,184 | 2/1969 | Heliot | 53/244 X |
| 3,499,551 | 3/1970 | McWilliams | 414/70 |
| 3,611,673 | 10/1971 | Carkhuff | 53/527 X |
| 3,766,706 | 10/1973 | Graham | 53/260 X |
| 3,824,759 | 7/1974 | Finn et al. | 53/438 X |
| 3,932,982 | 1/1976 | Klapp | 53/244 |
| 4,195,737 | 4/1980 | Rysti | 414/77 X |
| 4,203,274 | 5/1980 | Warkentin et al. | 53/244 X |
| 4,237,677 | 12/1980 | Klapp | 53/244 X |
| 4,433,526 | 2/1984 | Nord | 53/534 X |

FOREIGN PATENT DOCUMENTS

| | | | |
|---|---|---|---|
| 8002415 | 11/1980 | PCT Int'l Appl. | 414/907 |
| 670611 | 4/1952 | United Kingdom | 53/535 |

*Primary Examiner*—John Sipos
*Assistant Examiner*—Steven P. Weihrouch
*Attorney, Agent, or Firm*—Bernard, Rothwell & Brown

[57] ABSTRACT

An apparatus and method for case packing flexible product-containing bags is described. Rows of flexible product-containing bags are fed onto a tongue assembly. The tongue assembly has a flat plate which guides the bags into a carton, a movable lip which supports the bags from below and means for moving the lip from a bag-supporting position to a non-supporting position. The tongue assembly containing the bags is inserted into the carton and the movable lip is moved into a non-supporting position, allowing the bags to drop into the carton. The flat plate is also used to partially compress bags which have already been deposited in the carton.

5 Claims, 7 Drawing Figures

APPARATUS AND METHOD FOR CASE PACKING FLEXIBLE BAGS

BACKGROUND OF THE INVENTION

1. Field of the Invention

This invention relates to an apparatus and method for the automated case packing of products contained in flexible bags.

2. Prior Art

Many products, particularly snack food products, such as cookies and potato chips, are sold to consumers in flexible bags, e.g., paper, plastic or foil bags. The product-containing flexible bags are usually case packed in cardboard cartons at the place of manufacture for shipment to the retailer.

The case packing of products in flexible bags has not become a highly automated process, in many instances being performed manually. This is due in part to the nature of the flexible product-containing bags. As a result of the bag-filling process, air is present in the flexible bag. This provides some product protection in the packing carton. In order to obtain maximum utilization of space in the packing carton, it is necessary to compress slightly the flexible bags which are loaded into the cartons in order to fit the total packing carton space. This is rather difficult to do in an automated process without damaging the items inside the bags.

Complicating the packing problem is the desire of retailers and salesmen to have the product-containing flexible bags packed vertically, i.e., in rows with the top edges facing up, rather than being packed in layers on their sides. The vertical packing arrangement allows the retailer to open the carton and count the bags without removing or disturbing any of the bags in the carton. Unfortunately, the vertical arrangement complicates the packing process. It is especially difficult to insert the last vertical row of bags without having to compress the preceding rows so much that the contents may be damaged.

There is a need in the art for equipment and methods for the automated case packing of product-containing flexible bags in a vertical arrangement.

SUMMARY OF THE INVENTION

This invention provides an apparatus for the automated case packing of products in flexible bags, wherein the flexible bags are partially compressible due to the entrapment of gas, e.g., air, inside the bags. The apparatus comprises: a tongue assembly for supporting, guiding and compressing flexible product-containing bags, said tongue assembly having a flat plate for supporting a row of flexible product-containing bags from the sides of the bags, a movable lip for supporting the flexible product-containing bags from the bottoms of the bags and means for moving the movable lip from a bag-supporting position to a non-supporting position to release a row of flexible product-containing bags after they have been inserted into a carton; means for holding an open carton in a bag-receiving position relative to the tongue assembly, such that the bottom of the carton is perpendicular to the flat plate; means for moving the tongue assembly toward the bottom of the open carton to guide a row of flexible product-containing bags into the carton and for retracting the tongue assembly after a row of flexible product-containing bags has been deposited in the carton; and means for moving the open carton, relative to the tongue assembly, in a direction perpendicular to the plane of the flat plate to compress a row of flexible product-containing bags in the carton or to index the tongue assembly into a position to guide a new row of flexible product-containing bags into the open carton.

There is also provided by this invention a method for case packing products in flexible bags, which method employs the above-described apparatus. The method comprises: positioning a carton with its top open in a bag-receiving position; feeding a row of flexible product-containing bags onto a tongue assembly, said tongue assembly having a flat plate for supporting the sides of the bags and a movable lip for supporting the bottoms of the bags; inserting the tongue assembly containing the rows of flexible product-containing bags into the open carton; moving the movable lip from a bag-supporting position to a non-supporting position to allow the row of flexible product-containing bags to drop to the bottom of the carton, with the top edges of the bags disposed toward the top of the carton; removing the tongue assembly from the carton and indexing the carton into position to receive another row of flexible product-containing bags; feeding a new row of flexible product-containing bags onto the tongue assembly and reinserting the tongue assembly into the carton; moving the carton so that the previously deposited row of flexible product-containing bags is partially compressed against the flat plate; depositing a new row of flexible product-containing bags into the carton in the same manner as the previous row and repeating the bag compressing and depositing procedure until the carton is filled.

BRIEF DESCRIPTION OF THE DRAWINGS

The apparatus and method of the invention will be clearly understood with reference to the accompanying drawings, which are briefly described below.

DESCRIPTION OF THE PREFERRED EMBODIMENTS

Figure 1:
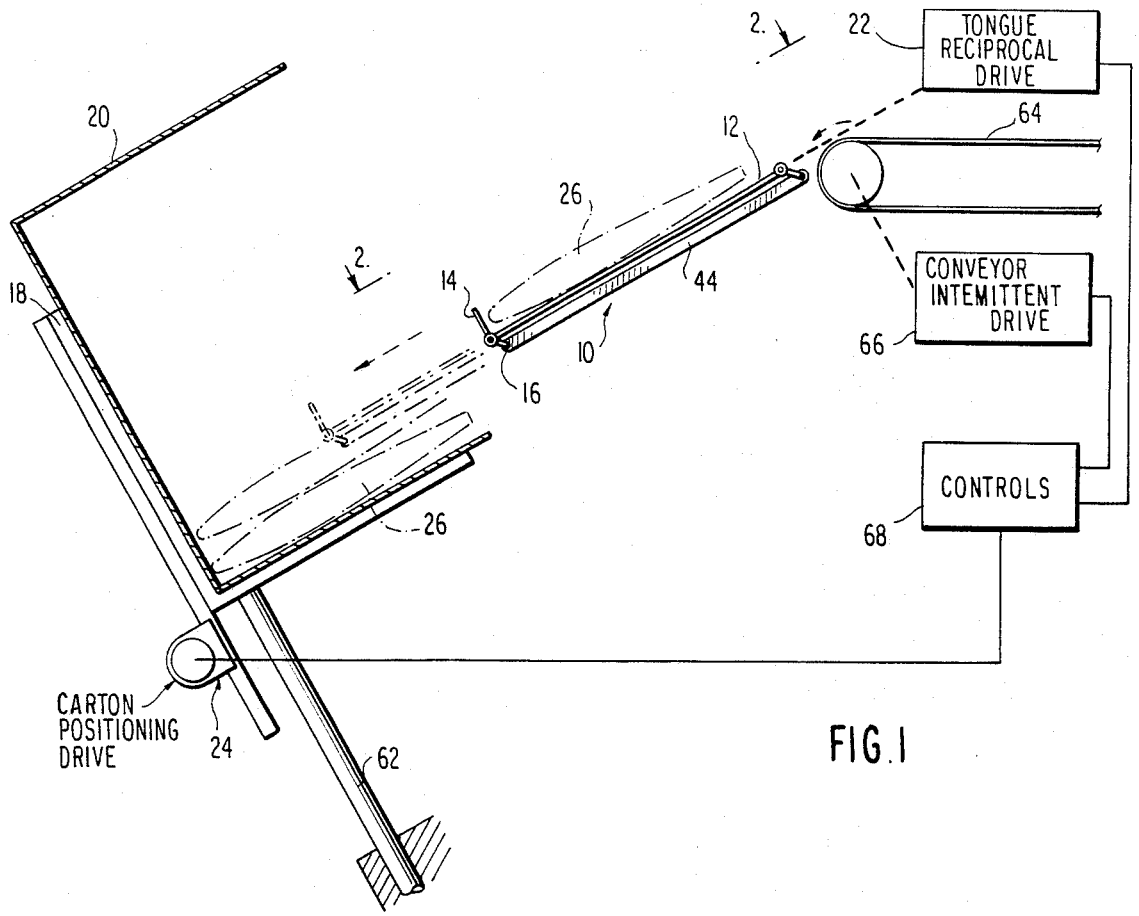
FIG. 1 is a schematic side view of the apparatus of the invention, illustrating the manner in which flexible product-containing bags are inserted into the open carton on the tongue assembly.

Referring to FIG. 1, the apparatus of the invention generally comprises a tongue assembly 10 having a flat plate 12, a movable lip 14 and a pivoting means 16 for moving the movable lip 14; a frame 18 for holding an open carton 20 in a bag-receiving position; a reciprocal drive 22 for moving the tongue assembly 10 toward and away from the bottom of the carton 20; and a drive means 24 for moving and indexing the open carton 20.

Figure 2:
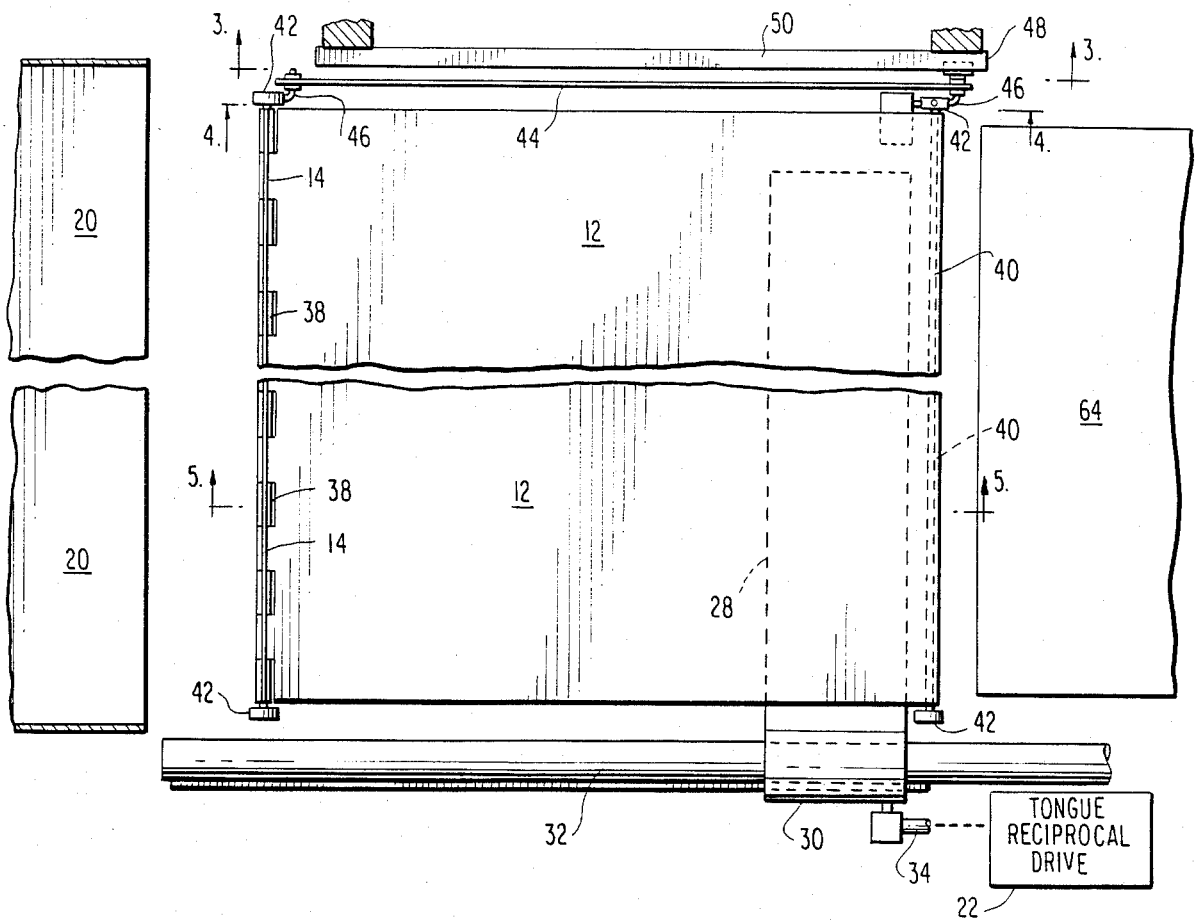
FIG. 2 is a top view of the tongue assembly.
Figure 5:
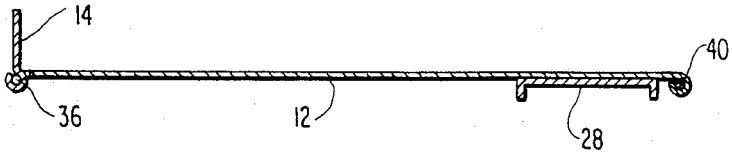
FIG. 5 is a side view taken along line 5—5 of FIG. 2.

The tongue assembly 10 serves the multiple purposes of guiding flexible product-containing bags 26 into the carton 20, supporting the flexible product-containing bags 26 from the sides and compressing the flexible product-containing bags 26 once they have been deposited in the carton 20 in order to make room for additional rows. As shown in FIGS. 2 and 5, the flat plate 12 is constructed of a thin, rigid sheet of metal with a smooth surface that permits the product-containing bags 26 to slide across it. The width of the flat plate 12 is slightly less than the width of the carton 20.

The flat plate 12 of the tongue assembly 10 is affixed, by means of a rectangular plate 28 attached to the bottom of the flat plate 12, to a sleeve 30 which rides on a guide shaft 32 toward and away from the carton 20. The sleeve 30, in turn, is affixed to a drive shaft 34 which is driven by the reciprocating drive means 22 (shown schematically) in order to move the tongue assembly 10 into and out of the carton 20. Any suitable reciprocating drive means 22 may be employed, including electromechanical or hydraulic means.

The movable lip 14 is constructed of a thin, rigid strip of metal. Its width is preferably about equal to the width of the bottoms of the flexible product-containing bags 26 so that it can support them from underneath. Its length is equal to the width of the flat plate 12. The movable lip 14 is rotatably affixed to the lower edge of the flat plate 12 by means of a rotatable shaft 36 and piano hinges 38, so that the movable lip 14 can be rotated from the bag-supporting position, shown in FIG. 1, to the non-supporting position, shown in FIGS. 1A and 1B, by rotating the shaft 36. In the bag-supporting position, the movable lip 14 extends perpendicularly from the plane of the flat plate 12. In the non-supporting position, the movble lip 14 is parallel to the plane of the flat plate 12. A second rotatable shaft 40 extends through an annular opening in the other end of the flat plate 12. The rotatable shaft 36 affixed to the piano hinges 38 and the rotatable shaft 40 at the other end of the flat plate 12 have cylindrical end caps 42. The rotatable shaft 36 affixed to the piano hinges 38 is connected to the rotatable shaft 40 at the other end of the flat plate 12 by means of a connecting rod 44, which is below the plane of the flat plate 12 when the movable lip 14 is in the bag-supporting position. The connecting rod 44 is affixed to two end caps 42 on the same side of the flat plate 12 by means of pins 46 which extend at right angles from the edge of the flat plate 12 through the connecting rod 44. The pins 46 rotate freely within the connecting rod 44, but they are rigidly affixed to the perimeters of the end caps 42, so that linear motion of the connecting rod 44 is converted to rotational motion of the end caps 42 and the shafts 36, 40.

Figure 3:
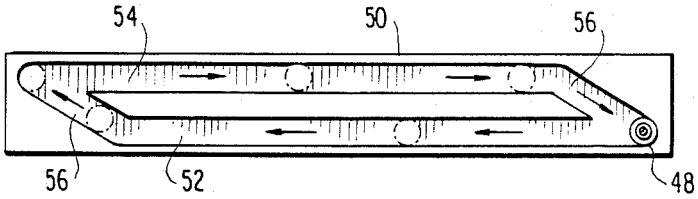
FIG. 3 is a side view taken along line 3—3 of FIG. 2.

The pin 46 which is connected to the end cap 42 further from the carton 20 extends through the connecting rod 44 to form an axle for a wheel 48 which is constrained to ride in a stationary track 50. The configuration of the track 50 is shown in FIG. 3. The track 50 has a lower horizontal track segment 52, an upper horizontal track segment 54 and two angled end segments 56. As the tongue assembly 10 moves into the carton 20, the wheel 48 rides along the lower horizontal track segment 52. When the tongue assembly 10 approaches a point near the bottom of the carton 20, the wheel 48 is forced to ride up the angled end segment 56 at one end of the track, thereby causing the connecting rod 44 to move from the position below the plane of the flat plate 12, shown in FIG. 1, to the position above the plane of the flat plate 12, shown in FIGS. 1A and 1B. This movement of the connecting rod 44 causes the movable lip 14 to be rotated by the piano hinges 38 from the bag-supporting position shown in FIG. 1 to the non-supporting position shown in FIGS. 1A and 1B. As the tongue assembly 10 is withdrawn from the carton 20, the wheel 48 rides back along the upper horizontal track segment 54 and then down the angled end segment 56 at the other end, forcing the movable lip 14 to be rotated by the piano hinges 38 back to the bag-supporting position shown in FIG. 1.

Figure 4:
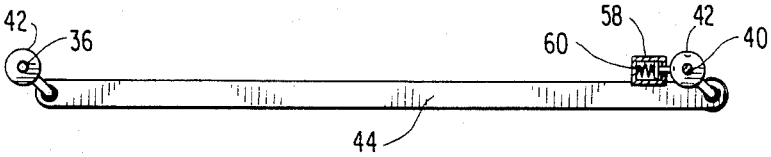
FIG. 4 is a side view taken along line 4—4 of FIG. 2.

A bias force which tends to maintain the movable lip in the bag-supporting position is exerted by means of a small compressed spring 58 which bears on the perimeter of the end cap 42 further from the carton 20, as shown in FIG. 4. The spring 58 is held in place within a spring compartment 60 which is affixed to the underside of the flat plate 12.

Figure 1A:
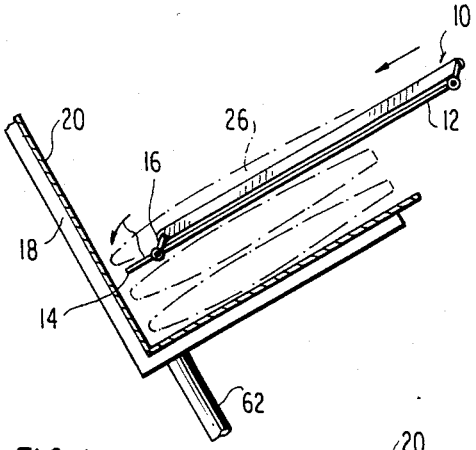
FIG. 1A is a partial schematic representation of the apparatus of the invention illustrating the movement of the movable lip to its non-supporting position to deposit a row of bags into the carton.
Figure 1B:
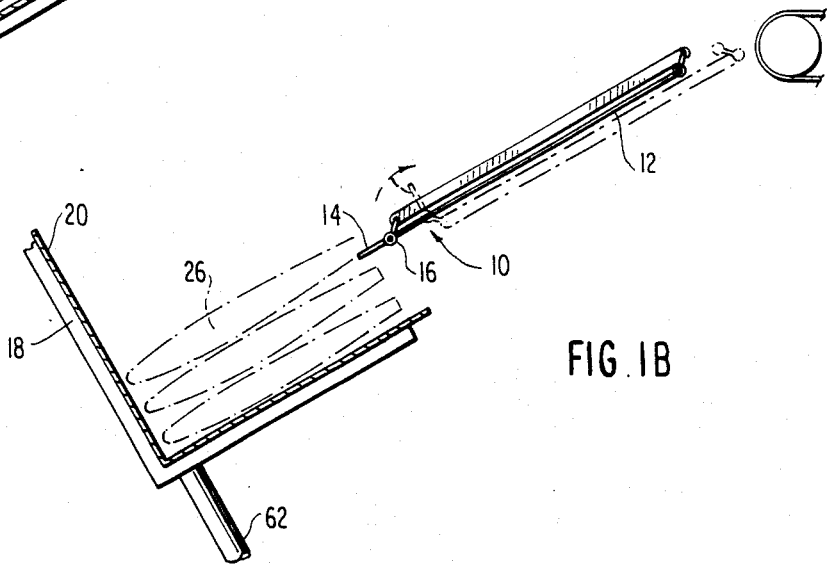
FIG. 1B is a partial schematic representation of the apparatus of the invention showing the tongue assembly being withdrawn from the carton with the movable lip in the non-supporting position.

The packing method of the invention can be readily understood with reference to FIGS. 1, 1A and 1B. To begin the packing operation, an open carton 20 is placed in a frame 18 which is suitably configured to hold the open carton 20 in a bag-receiving position, i.e., with the open top disposed toward the tongue assembly 10 and the carton preferably at an angle of about 45° from vertical, the bottom panel of the open carton 20 being perpendicular to the plane of the flat plate 12. The frame 18 is driven along a guide shaft 62 by a drive means 24 which is capable of moving the carton 20 up or down the guide shaft 62. The tongue assembly 10 is positioned with its upper edge adjacent the end of an endless conveyor belt 64, which is connected to an intermittent drive means 66. The reciprocal drive means 22 for the tongue assembly 10, the intermittent drive means 66 for the conveyor belt 64 and the drive means 24 for the carton 20 are linked through a controller 68 which is capable of coordinating the motions of the carton 20, the conveyor belt 64 and the tongue assembly 10 in the manner described hereafter.

Initially, the open carton 20 is positioned such that the flat plate 12 is lined up just inside the lower end panel of the carton 20. A row of flexible product-containing bags 26 is fed onto the surface of the flat plate 12 by means of the conveyor belt 64. Typically, the bags 26, which are represented with broken lines, are fed in rows of two bags 26, side-by-side onto the flat plate 12; however, rows of three or more, or single bags 26 may be fed if desired. The tongue assembly 10 containing the flexible product-containing bags 26 is inserted into the carton 20 by the reciprocal drive means 22, as indicated by the broken arrow in FIG. 1. As the tongue assembly 10 approaches the bottom panel of the carton 20, the movable lip 14 is rotated into the non-supporting position shown in FIG. 1A by the motion of the wheel 48, connecting rod 44 and piano hinges 38, as previously described. The carton 20 must be positioned relative to the tongue assembly 10, such that there is sufficient clearance for the movable lip 14 to rotate into the non-supporting position when the tongue assembly 10 is fully inserted. The first row of flexible product-containing bags 26 is thereby freed to drop to the bottom of the carton 20. The tongue assembly 10 is then retracted from the carton 20 to its position adjacent the conveyor belt 64. The return motion of the wheel 48 in the track 50 forces the connecting rod 44 and piano hinges 38 to return the movable lip 14 to its bag-supporting position, as shown in FIG. 1B.

After the tongue assembly 10 has been retracted, the carton 20 is indexed downward into position to receive the next row of flexible product-containing bags 26. The next row of flexible product-containing bags 26 is fed onto the flat plate 12 from the conveyor belt 64 and the tongue assembly 10 is reinserted into the carton 20. However, just prior to reaching the point at which the movable lip 14 is forced into the non-supporting position, the motion of the tongue assembly 10 is stopped. The carton 20 is moved slightly upward so that the previously deposited row of bags 26 is slightly compressed against the bottom surface of the flat plate 12, but not so much as to damage the contents. The motion of the tongue assembly 10 is then resumed so that the movable lip 14 is rotated into the non-supporting position and the next row of flexible product-containing bags 26 is deposited. The tongue assembly 10 is retracted from the carton 20 and the process of compressing and depositing rows of flexible product-containing bags 26 is repeated until the carton 20 is filled.

It will be appreciated that suitable automatic control devices are commercially available which can be preprogrammed to direct and coordinate the desired motions of the various components described herein.

Since many modifications, variations and changes in detail may be made to the described embodiment, it is intended that all matter in the foregoing description and shown in the accompanying drawings be interpreted as illustrative and not in a limiting sense.

What is claimed is:

1. Apparatus for case packing of products in flexible bags, said bags being partially compressible, the apparatus comprising:

(a) a tongue assembly for supporting, guiding and compressing flexible product-containing bags, said tongue assembly having a flat plate for supporting a row of flexible product-containing bags from the sides of the bags, a movable lip for supporting the flexible product-containing bags from the bottoms of the bags and means for moving the movable lip from a bag-supporting position to a non-supporting position to release a row of flexible product-containing bags after they have been inserted into a carton;

(b) means for holding an open carton in a bag-receiving position relative to the tongue assembly, such that the bottom of the carton is perpendicular to the flat plate;

(c) means for moving the tongue assembly toward the bottom of the open carton to guide a row of flexible product-containing bags into the carton and for retracting the tongue assembly after a row of flexible product-containing bags has been deposited in the carton; and (d) means for moving the open carton, relative to the tongue assembly, in a direction perpendicular to the plane of the flat plate to compress a row of flexible product-containing bags in the carton and for indexing the carton into a position to receive a new row of flexible product-containing bags.

2. Apparatus as claimed in claim 1, wherein said movable lip is rotatably affixed to the bottom edge of the flat plate such that the lip, in its bag-supporting position, extends perpendicularly from the plane of the flat plate and, in its non-supporting position, is parallel to the plane of the flat plate.

3. Apparatus as claimed in claim 1, wherein the carton holding means is positioned to hold the open carton at about a 45° angle from vertical and the flat plate of the tongue assembly is positioned at an angle about 45° from vertical and perpendicular to the bottom of the carton.

4. Method for case packing products in flexible bags, said bags being partially compressible, the method comprising: positioning a carton with its top open in a bag-receiving position; feeding a row of flexible product-containing bags onto a tongue assembly, said tongue assembly having a flat plate for supporting the sides of the bags and a movable lip for supporting the bottoms of the bags; inserting the tongue assembly containing the rows of flexible product-containing bags into the open carton; moving the movable lip from a bag-supporting position to a non-supporting position to allow the row of flexible product-containing bags to drop to the bottom of the carton, with the top edges of the bags disposed toward the top of the carton; removing the tongue assembly from the carton and indexing the carton into position to receive another row of flexible product-containing bags; feeding a new row of flexible product-containing bags onto the tongue assembly and reinserting the tongue assembly into the carton; moving the carton so that the previously deposited row of flexible product-containing bags is partially compressed against the flat plate; depositing a new row of flexible product-containing bags into the carton in the same manner as the previous row and repeating the bag compressing and depositing procedure until the carton is filled.

5. Method as claimed in claim 4, wherein the carton is positioned with its bottom at an angle of about 45° from vertical.

* * * * *